US008260161B2

(12) United States Patent
Ito

(10) Patent No.: US 8,260,161 B2
(45) Date of Patent: Sep. 4, 2012

(54) IMAGE FORMING APPARATUS

(75) Inventor: Yukifumi Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 550 days.

(21) Appl. No.: 12/472,789

(22) Filed: May 27, 2009

(65) Prior Publication Data

US 2009/0324265 A1 Dec. 31, 2009

(30) Foreign Application Priority Data

Jun. 27, 2008 (JP) ..... 2008-168893

(51) Int. Cl.
*G03G 15/00* (2006.01)
*G03G 15/20* (2006.01)

(52) U.S. Cl. ..... 399/43; 399/38; 399/67; 399/70

(58) Field of Classification Search ..... 399/38, 399/43, 44, 67–70
See application file for complete search history.

(56) References Cited

U.S. PATENT DOCUMENTS

| | | | | |
|---|---|---|---|---|
| 5,652,950 | A * | 7/1997 | Kim | 399/70 |
| 7,742,731 | B2 * | 6/2010 | Shinkawa et al. | 399/327 |
| 2004/0042810 | A1 * | 3/2004 | Cho | 399/69 |
| 2004/0264992 | A1 * | 12/2004 | Shiraishi | 399/69 |
| 2006/0127118 | A1 * | 6/2006 | Kishi et al. | 399/69 |
| 2007/0110459 | A1 * | 5/2007 | Oominami et al. | 399/38 |
| 2008/0118263 | A1 * | 5/2008 | Nakayama et al. | 399/69 |

FOREIGN PATENT DOCUMENTS

JP 2000-137407 A 5/2000

* cited by examiner

*Primary Examiner* — Walter L Lindsay, Jr.
*Assistant Examiner* — Jessica L Eley
(74) *Attorney, Agent, or Firm* — Panitch Schwarze Belisario & Nadel LLP

(57) ABSTRACT

An image forming apparatus includes a control mechanism capable of selecting a plurality of print modes and a fixing device fixing an image developed based on one of the print modes selected by the control mechanism. The control mechanism selects any one of the print modes based on a successive print sheet number determined by print information received from a host device and a power consumption amount of each of the print modes calculated from fixing temperature of the fixing device prior to starting print operation.

14 Claims, 7 Drawing Sheets

IMAGE FORMING APPARATUS

BACKGROUND OF THE INVENTION

1. Field of the Invention

The present invention relates to an image forming apparatus developing and outputting image data input from a host device on a recording medium based on certain control.

2. Description of Related Art

A related art image forming apparatus such as a printer, a photocopier, a facsimile machine, and an electrophotographic multi-color recording device generally performs print control and starts print operation. Particularly, data is processed for development of a toner image on a recording medium based on print data transmitted from a host device, and a fixing device fixing the toner image transferred to the recording medium with the heat increases temperature thereof to a print startable level. Subsequently, the print operation is started.

Japanese Un-examined Patent Application Publication No. 2000-137407 discloses a control method for advancing print start time and shortening a print end time by deceleration of operation speed of the fixing device in a case where current temperature of the fixing device does not reach a prescribed print startable level.

An image forming apparatus of recent years is demanded to reduce a power consumption amount thereof in addition to a demand of shortening print time thereof. However, the related image forming apparatus described above has a lack of consideration with respect to the power consumption amount despite capability of shortening the print time thereof.

The present invention provides an image forming apparatus capable of reducing a power consumption amount in print operation and optimizing the power consumption amount and print time.

BRIEF SUMMARY OF THE INVENTION

According to one aspect of the invention, an image forming apparatus includes: a control mechanism capable of selecting a plurality of print modes; and a fixing device fixing an image developed based on one of the print modes selected by the control mechanism. The control mechanism selects any one of the print modes based on a successive print sheet number determined by print information received from a host device and a power consumption amount of each of the print modes calculated from fixing temperature of the fixing device prior to starting print operation.

According to another aspect of the invention, an image forming apparatus includes: a control mechanism capable of selecting a plurality of print modes; and a fixing device fixing an image developed based on one of the print modes selected by the control mechanism. The control mechanism determines one of the print modes based on a successive print sheet number determined by print information received from a host device, a power consumption amount of each of the print modes determined from fixing temperature of the fixing device prior to starting print operation, a total print time for print operation, and a priority sequence parameter set beforehand indicating a power consumption amount priority or a print speed priority, and allows the print operation to be performed using the print mode determined.

Additional features and advantages of the present invention will be more fully apparent from the following detailed description of embodiments, the accompanying drawings and the associated claims.

BRIEF DESCRIPTION OF THE DRAWINGS

A more complete appreciation of the aspects of the invention and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
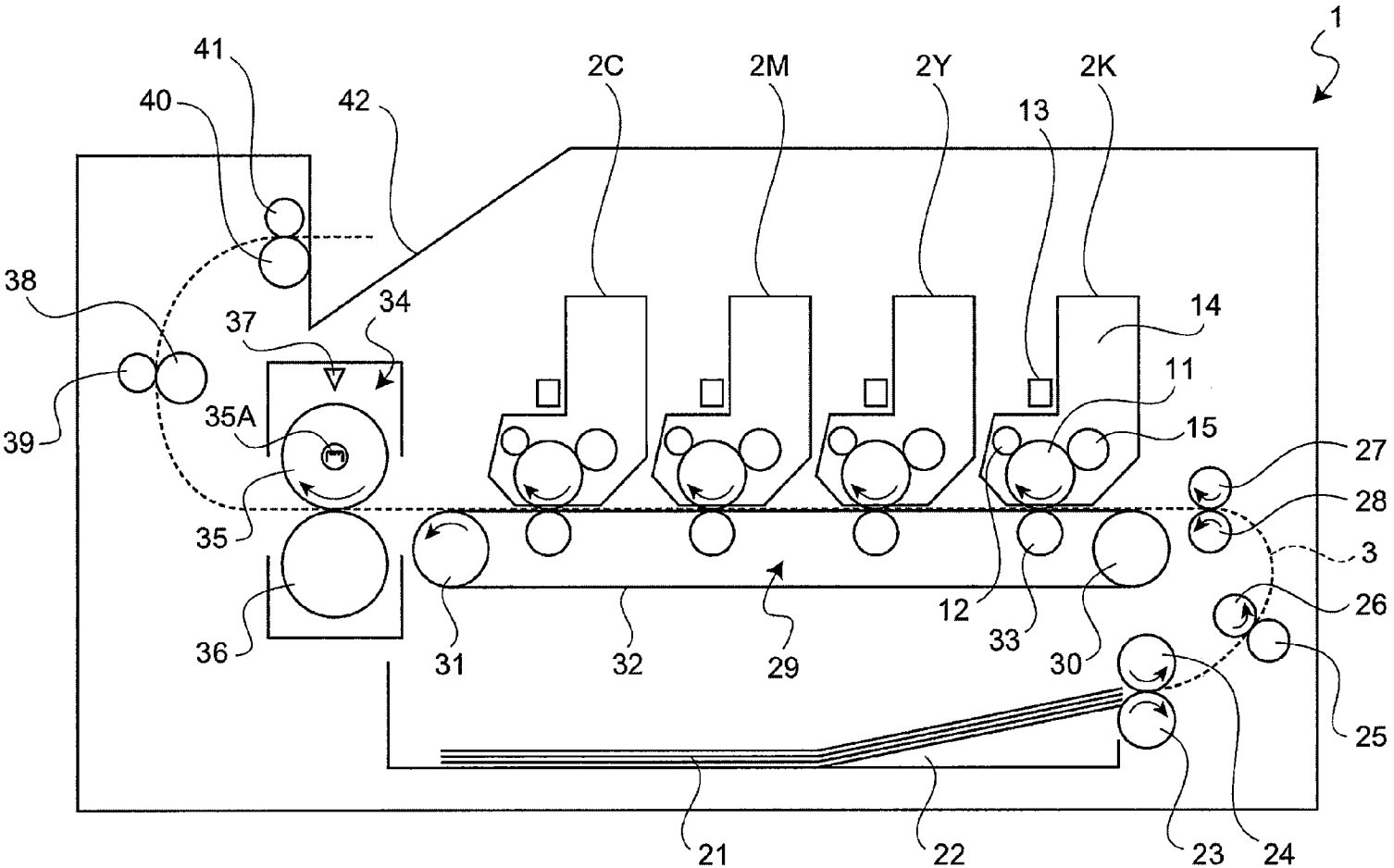
FIG. 1 is a schematic diagram illustrating an image forming apparatus according to a first embodiment of the present invention.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, like reference numerals designate identical or corresponding parts throughout the several views, an image forming apparatus according to an embodiment of the present invention is described.

First Embodiment

An image forming apparatus 1 according to a first embodiment includes a controller capable of selecting a plurality of print modes and a fixing device fixing an image developed based on the print mode selected by the controller. The controller selects any one of the print modes based on a number of successive print sheets determined by print information received from a host device and a power consumption amount of each of the print modes calculated from fixing temperature of the fixing device prior to starting the print operation.

Referring to FIG. 1, the image forming apparatus 1 according to the first embodiment is illustrated.

The image forming apparatus 1 is, for example, an electrophotographic image recording apparatus employing an LED tandem method. The image forming apparatus 1 includes: image forming units 2C, 2M, 2Y, and 2K printing images on a recording medium 21 based on image information corresponding to respective colors of cyan, magenta, yellow, and black; and a sheet conveyance path 3 in a substantially letter "S" shape. The recording medium 21 is fed from a sheet cassette 22, disposed in a start point of the sheet conveyance path 3, storing the recording medium 21 therein. The recording medium 21 having the image information printed thereon is ejected to a face-down stacking area 42 disposed in an end point of the conveyance path 3.

A description is now given of the image forming units 2C, 2M, 2Y, and 2K disposed inside the image forming apparatus 1. Since each of the image forming units 2C, 2M, 2Y, and 2K is substantially similar to one another except for the color of toner, a description of the image forming units 2C, 2M, 2Y, and 2K is hereafter given by using an image forming unit 2 as representative of the image forming units 2C, 2M, 2Y, and 2K. Each of the image forming unit 2 includes: a photosensitive drum 11 carrying thereon electrostatic latent image formed based on the image information; a charging roller 12 allowing surface of the photosensitive drum 11 to accumulate electric charge thereon; an exposure device 13, disposed to the image forming apparatus 1, irradiating the surface of the photosensitive drum 11 with light corresponding to the image information; a toner cartridge 14 storing the toner therein; and a development roller 15 developing the electrostatic latent image on the surface of the photosensitive drum 11 with the toner. The image forming unit 2 is detachably disposed with respect to the image forming apparatus 1. A description of each of the components included in the image forming unit 2 is described in detail below.

The photosensitive drum 11, serving as image carrier, forms a developer image thereon. The photosensitive drum 11 is capable of accumulating the electric charge on the surface thereof to carry the electrostatic latent image formed thereon based on the image information. The photosensitive drum 11 is cylindrical member and is disposed in a rotatable manner. The photosensitive drum 11 includes a photosensitive layer formed on a conductive base layer. The photosensitive layer includes a photoconductive layer and a charge transport layer, and the conductive base layer is made of aluminum, for example.

The charging roller 12 applies prescribed a positive voltage or a negative voltage to the surface of the photosensitive drum 11 by a power source (not shown), thereby allowing the electric charge to be accumulated with respect to the surface of the photosensitive drum 11. The charging rollers 12 is disposed in a rotatable manner while contacting the surface of the photosensitive drum 11. Such a charging roller 12 includes a conductive metal shaft coated with semi-conductive rubber made of silicon, for example.

The exposure device 13 is disposed above the photosensitive drum 11, and irradiates the surface of the photosensitive drum 11 with the light corresponding to the image information, thereby forming the electrostatic latent image on the surface of the photosensitive drum 11. Such exposure device 13, for example, includes a combination of a plurality of LED elements, lens array, and an LED driving element.

The toner cartridge 14 serves as a container storing the toner therein and is disposed above the development roller 15. The toner cartridge 14 is detachably disposed with respect to the image forming unit 2 in such a manner as to be replaced in a case where the toner is consumed.

The development roller 15 serves as a development unit forming a toner layer on the photosensitive drum 11, and is disposed in a rotatable manner while contacting the surface of the photosensitive drum 11 with certain pressure. The development roller 15 is in a cylindrical shape. The development roller 15 conveys the toner to the photosensitive drum 11 with rotation thereof, and develops the electrostatic latent image formed on the photosensitive drum 11 with the toner. The development roller 15 includes a conductive metal shaft coated with a semi-conductive polyurethane rubber member, for example.

A description is now given of the sheet conveyance path 3 disposed inside the image forming apparatus 1. The sheet cassette 22 storing the recording medium 21 and the face-down stacking area 42 are disposed respectively in the start point and the end point along the sheet conveyance path 3. A retard roller 23, a feed roller 24, a pressure roller 25, a registration roller 26, a pressure roller 27, a registration roller 28, a transfer belt unit 29, transfer rollers 33, a fixing device 34, a conveyance roller 38, a conveyance roller 39, an ejection roller 40, and an ejection roller 41 are disposed along the sheet conveyance path 3. Each of the components disposed along the sheet conveyance path 3 is described in detail below.

The sheet cassette 22 stores a plurality of recording media 21 therein. The sheet cassette 22 supplies each of the plural recording media 21 toward the image forming units 2 in the image forming apparatus 1 when the print operation is started. The sheet cassette 22 is detachably disposed with respect to the image forming apparatus 1. The recording medium 21 serves as a recording sheet having a prescribed size, and is used for development of a monochrome or multi-color image information thereon. The recording medium 21 is, for example, a recycled sheet, a glossy sheet, a high-quality sheet, and an OHP film.

The retard roller 23 rotates while being pressed against the recording medium 21 stored in the sheet cassette 22, thereby separately feeding the recording medium 21 sheet by sheet from the sheet cassette 22. The sheet roller 24 is disposed opposite to the retard roller 23 in such a manner as to sandwich the recording medium 21 therebetween, so that recording medium 21 is conveyed to the pressure roller 25 and the registration roller 26. Here, the pressure roller 25 and the registration roller 26 are disposed opposite to each other in such a manner as to sandwich the recording medium 21 being conveyed therebetween. The pressured roller 25 is pressed by the registration roller 26 and is rotated, so that the pressure roller 25 and the registration roller 26 convey the recording medium 21 to the pressure roller 27 and the registration roller 28 while correcting the recording medium 21 on the skew. The pressure roller 27 and the registration roller 28 are disposed opposite to each other in such a manner as to sandwich the recording medium 21 being conveyed. The pressure roller 27 is pressed by the registration roller 28 and is rotated, so that the pressure roller 27 and the registration roller 28 convey the recording medium 21 to the transfer belt 32 (described later) while correcting the recording medium 21 on the skew.

The transfer unit 29 includes an idle roller 30, a driver roller 31, and the transfer belt 32. The transfer belt 32 serves as a conveyance member conveying the recording medium 21 to the image forming units 2 for development of the image information. The transfer belt 32 is an endless belt and absorbs the recording medium 21 on a circumference surface thereof. As illustrated in FIG. 1, the transfer belt 30 extends across the idle roller 30 and the drive roller 31 disposed at each end thereof. The idle roller 30 and the drive roller 31 apply certain tensile force to the transfer belt 32, and are made of high friction resistance members. The transfer belt 32 is driven by rotation of the idle roller 30 and the drive roller 31 rotated by a drive system (not shown). The transfer roller 33 is disposed below the photosensitive drums 11 in a rotatable manner, and contacts the recording medium 12 in such a manner as to sandwich the recording medium 21 with the photosensitive drums 11. The transfer roller 33 is supplied with a bias voltage reverse to an electric potential charged to the toner, and transfer the toner images formed on the respective photosensitive drums 11 to the recording medium 21.

The fixing device 34 includes a fixing roller 35, a pressure roller 36, and a thermistor 37. The fixing roller 35 and the pressure roller 36 are disposed opposite to each other in such a manner as to sandwich therebetween the recording medium 21 being conveyed by the transfer belt 32, and fix the toner image developed by each of the image forming units 2 on the recording medium 2. Particularly, the toner image adhered to the recording medium 21 is melted using the heat supplied from a heater 35A, having a halogen lamp, for example, disposed inside the fixing roller 35, and is fixed on the recording medium 21 by the pressure applied by the pressure roller 26. The thermistor 37 measures a surface temperature of the fixing roller 35. The pressure roller 36 is rotated with the rotation of the fixing roller 35.

The conveyance roller 38 and the conveyance roller 39 are disposed opposite to each other in such a manner as to sandwich therebetween the recording medium 21 being conveyed from the fixing device 34. The conveyance roller 39 is rotatably driven by rotation of the conveyance roller 38, so that the conveyance rollers 38, 39 convey the recording medium 21 to the ejection rollers 40, 41. As illustrated in FIG. 1, the ejection rollers 40, 41 are disposed opposite to each other in such a manner as to sandwich therebetween the recording medium 21 being conveyed by the conveyance rollers 38, 39. The ejection roller 41 is rotatably driven by rotation of the ejection roller 40, so that ejection rollers 40, 41 eject the recording medium 21 on the face-down stacking area 42. Herein, the face-staking area 42, serving as a storage area, stacks the recording medium 21 having the developed image information ejected thereon.

Figure 2:
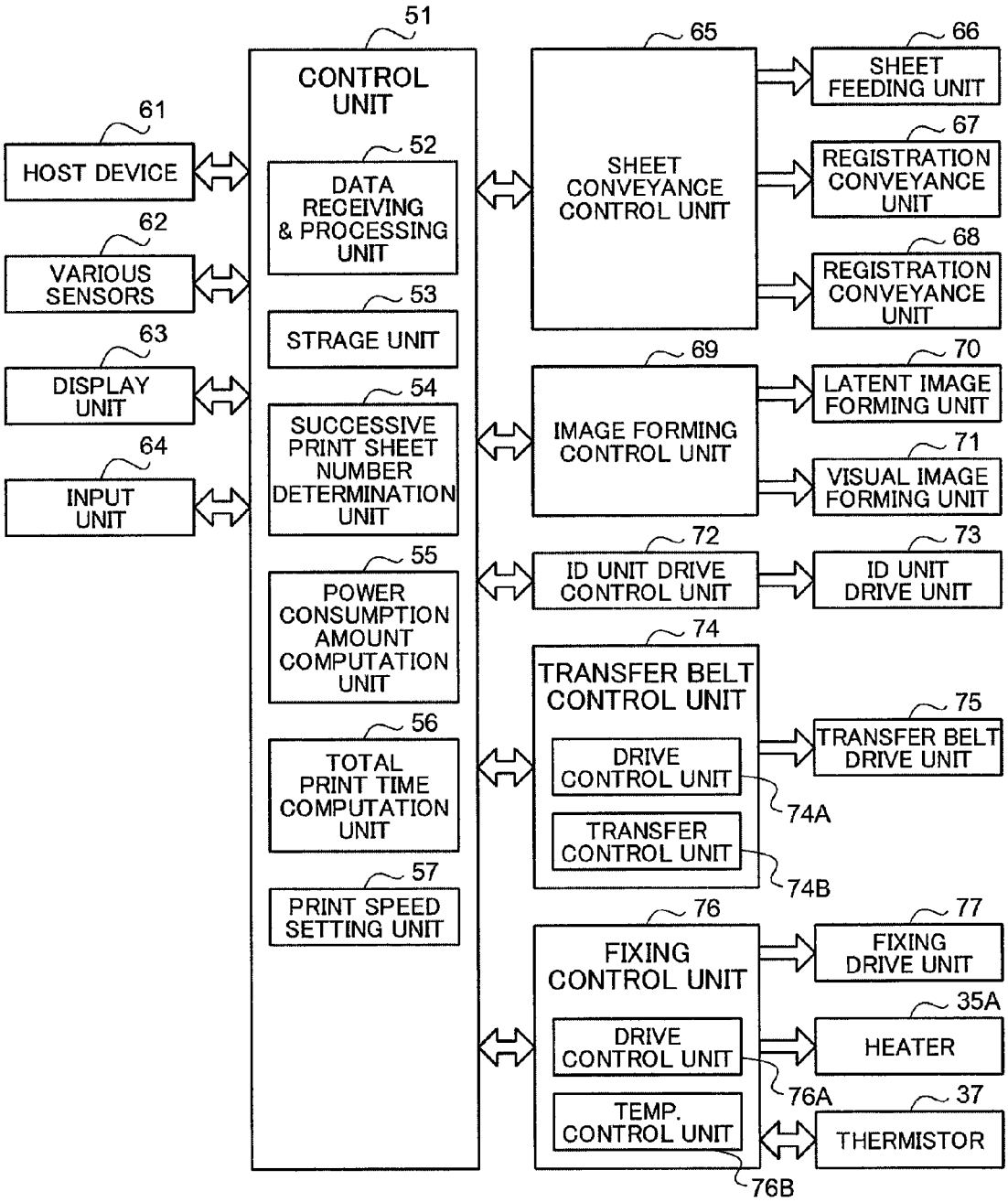
FIG. 2 is a block diagram illustrating the image forming apparatus according to the first embodiment of the present invention.

A description of control of the image forming apparatus 1 is described with reference to a block diagram of FIG. 2.

The image forming apparatus 1 includes a control unit 51 having a microprocessor, a central processing unit (CPU), a read only memory (ROM), a random access memory (RAM), an input and output port, and a timer. The image forming apparatus 1 controls a series of development processes developing the image information on the recording medium 21 by an instruction from the control unit 51. Such a control unit 51 interconnects with each of a host device 61, various sensors 62, a display unit 63, an input unit 64, a sheet conveyance control unit 65, an image forming control unit 69, an ID unit drive control unit 72, a transfer belt control unit 74, and a fixing control unit 76. The control unit 51 notifies each of the control units of print data set, recording medium information, and setting speed, for example. The components disposed inside the control unit 51 and the components interconnected with the control unit 51 are described in detail below.

The control unit 51 includes therein: a data receiving and processing unit 52; a storage unit 53; a successive print sheet number determination unit 54; a power consumption amount computation unit 55; a total print time computation unit 56; and a print speed setting unit 57. The data receiving and processing unit 52 receives, for example, a control command and the print data transmitted from the host device 61 (described later) and processes the print data so as to be developed on the recording medium 21. The storage unit 53 temporarily stores each of data processed inside the control unit 51. The successive print sheet number determination unit 54 determines a number of successive printable sheets (also referred to as a successive print sheet number) for the recording medium 21. The power consumption amount computation unit 55 computes the power consumption amount with respect to each print speed based on the successive print sheet number for the recording medium 21 and the recording medium information. The total print time computation unit 56 computes a total print time with respect to each print speed based on the successive print sheet number for the recording medium 21 and the recording medium information. The print speed setting unit 57 sets appropriate print speed based on the power consumption amount computed by the power consumption amount computation unit 55.

Each of the components interconnected with the control unit 51 is now described. The host device 61 is, for example, a personal computer, and transmits the image data to be printed on the recording medium 21 to the control unit 51. The various sensors 62 are disposed inside the image forming apparatus 1. The various sensors 62 include, for example, a sheet sensor detecting existence or nonexistence of the recording medium 21, and a temperature and humidity sensor detecting the temperature and humidity. The display unit 63 serves as a display device and is disposed to the image forming apparatus 1. The display unit 63 displays, for example, a print state of the image forming apparatus 1 to an operator. The input unit 64 serves as an input device and is disposed to the image forming apparatus 1. The input unit 64 is used by the operator to change an internal setting of the image forming apparatus 1.

The sheet conveyance control unit 65 controls speed and driving timing of each of rollers disposed in a sheet feeding unit 66, a registration conveyance unit 67, and a registration conveyance unit 68. The image forming control unit 69 controls: a latent image forming unit 70 forming the electrostatic latent image on the photosensitive drum 11 by the exposure device 13 based on the print data; and a visual image forming unit 71 forming the toner layer on the photosensitive drum 11 by the development roller 15. The image forming control unit 69 controls the latent image forming unit 70 and the visual image forming unit 71, thereby developing the toner image on the recording medium 21. The ID unit drive control unit 72 controls, for example, rotation speed and rotation timing of each component of an ID unit drive unit 73. The transfer belt control unit 74 includes: a drive control unit 74A controlling the idle roller 30 and the drive roller 31 disposed at respective ends of the transfer belt 32; and a transfer control unit 74B allowing the toner image formed on the surface of the photosensitive drum 11 to be transferred to the recording medium 21 by the transfer roller 33. Such a transfer belt control unit 74 controls a transfer belt drive unit 75. The fixing control unit 76 includes: a drive control unit 76A controlling drive of the fixing device 34; and a temperature control unit 76B controlling temperature of the heater 35A disposed inside the fixing device 34. Such a fixing control unit 76 supplies a command to each of a fixing drive unit 77, the heater 35A, and the thermistor 37, so that the rotation speed and the driving timing of the fixing roller 35 is controlled. Moreover, the fixing control unit 76 controls ON and OFF of the heater 35A based on the temperature information obtained from the thermistor 37 disposed inside the fixing device 34, thereby allowing the heater 35 to be approximately set target temperature.

Now, a description is given of a power consumption amount Wn (Wh) consumed by the fixing device 34 in a case where the image forming apparatus 1 develops the print data on the recording medium 21. A parameter used for calculation of the power consumption amount Wn (Wh) consumed by the fixing device 34 is stated in TABLE 1.

TABLE 1

| PARAMETER | UNIT | DESCRIPTION OF PARAMETER |
|---|---|---|
| $T_0$ | (° C.) | CURRENT TEMP. OF FIXING ROLLER |
| Tn | (° C.) | SET TARGET TEMP. OF FIXING ROLLER |
| x | (SHEET) | SUCCESSIVE PRINT SHEET NUMBER OF RECORDING MEDIUM |
| L | (mm) | LENGTH OF RECORDING MEDIUM |
| d | (mm) | DISTANCE BETWEEN RECORDING MEDIA IN THE COURSE OF SUCCESSIVE PRINT OPERATION |
| Vn | (mm/sec) | PRINT SPEED OF RECORDING MEDIUM |
| Pw | (W) | POWER CONSUMPTION NEEDED TO INCREASE TEMP. OF FIXING ROLLER TO SET TARGET TEMP. FROM TEMP. AT BEGINNING OF OPERATION OF IMAGE FORMING APPARATUS |
| Pc | (W) | POWER CONSUMPTION NEEDED TO PERFORM PRINT OPERATION BY OPERATION OF IMAGE FORMING APPARATUS ON CONDITION OF CERTAIN TEMP. T AND CERTAIN SPEED V |
| a | (° C./sec) | TEMP. GRADIENT FOR SURFACE TEMP. OF FIXING ROLLER TO BE INCREASED IN ONE SECOND |

Each of a temperature gradient "a" (degrees Celsius/sec), a power consumption Pw (W), and a power consumption Pc (W) is a unique amount to the image forming apparatus 1 and the fixing device 34. Each of such unique amounts is tabled in the control unit 51 using a measurement amount obtained by an experiment performed beforehand, or using a calculation Formula derived from a theoretical value.

Generally, the light of the heater 35A disposed inside the fixing roller 35 is turned on with high duty so as to shorten a time period from a time at which the image forming apparatus 1 is activated to a time at which the print operation becomes performable, causing an increase in the power consumption amount Pw (W). However, when the fixing roller 35 once reaches a set target temperature Tn (degrees Celsius), and the print operation becomes performable, the light of the heater 35A is turned on with low duty while the image data are successively printed on the recording medium 21, thereby allowing the power consumption amount Pc (W) to be smaller than the power consumption amount Pw (W). Although the power consumption Pc (W) may vary depending on a class of the recording medium 21, operation environment of the image forming apparatus 1, a number of print sheets of the recording medium 21, and the like, the power consumption Pc (W) is assumed to be a constant amount for the sake of simplicity. Herein, a time "tw" (sec) needed to increase the temperature of the fixing roller 35 from $T_0$ (degrees Celsius) to Tn (degrees Celsius) is calculated by Formula 1 (stated later). Moreover, a time "tc" (sec) is calculated by Formula 2, where the time "tc" represents a time during which the print operation is performed while the fixing roller 35 is staying at the set target temperature Tn (degrees Celsius). In a case where a traveling distance of the recording medium 21 is long, the length of the traveling distance can be added to a numerator of a right-hand side of the Formula 2, thereby enhancing calculation accuracy.

$$tw=(Tn-T_0)/a \qquad \text{Formula 1}$$

$$tc=\{x\times L+(x-1)\times d\}/Vn \qquad \text{Formula 2}$$

The power consumption amount Wn (Wh) consumed by the fixing device 34 from a time at which the image forming apparatus 1 begins to operate and to a time at which the print operation is ended is calculated by the Formula 1 for calculation of the "tw" (sec), the Formula 2 for calculation of the "tc" (sec), the power consumption amount Pw (W) and the power consumption amount Pc (W). Particularly, the power consumption amount Wn (Wh) is calculated by Formula 3 (stated later). The fixing device 34 has the highest power consumption amount in a case where the image forming apparatus 1 is operated. According to the first embodiment, the fixing device 34 having the highest power consumption amount is considered for calculation of the power consumption amount Wn (Wh). However, a power consumption amount of any one of a drive motor, a fan, a power source, the exposure device 13 and the like may be calculated, or a total power consumption amount combining each of the power consumption amounts of the drive motor, the fan, the power source, the exposure device 13, and the like may be calculated.

$$Wn=(Pw\times tw+Pc\times tc)/60/60 \qquad \text{Formula 3}$$

Figure 3:
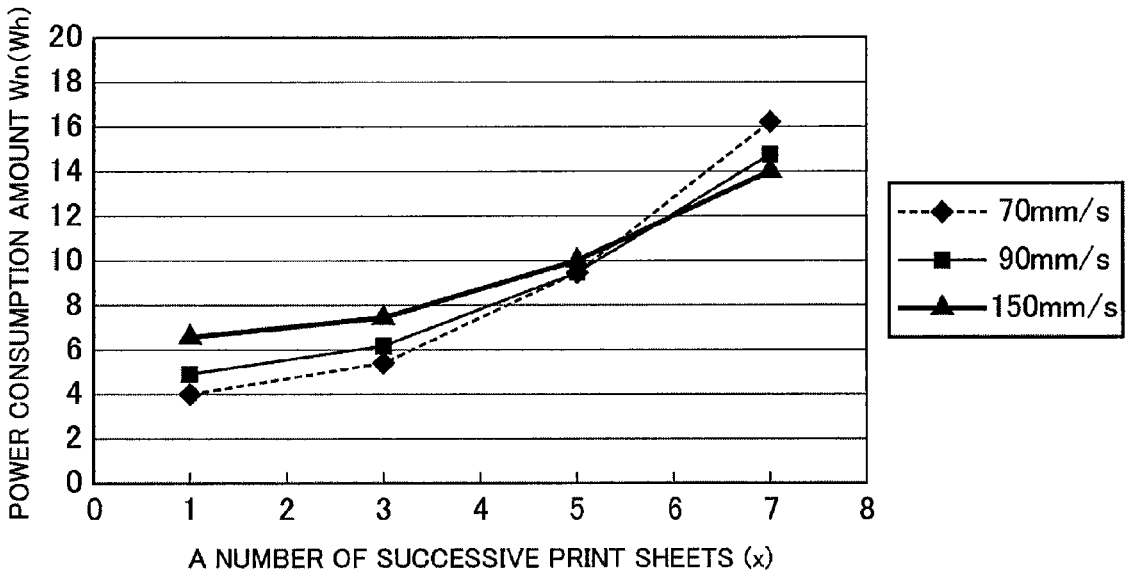
FIG. 3 is a graph illustrating a relationship between a number of successive print sheets and a power consumption amount with respect to each print speed in a case where the image forming apparatus according to the first embodiment of the present invention is started from a temperature of 20 degrees Celsius.

Referring to FIG. 3, a relationship between the power consumption amount Wn (Wh) in the fixing device 34 and the number of successive print sheets (x) with respect to each print speed Vn (mm/sec) is illustrated. The fixing roller 35 has the current temperature $T_0$ (degrees Celsius) of 20 degrees Celsius where the print operation is startable. The print speed Vn is 70, 90, and 150 (mm/sec) as illustrated in FIG. 3.

Herein, the fixing roller 35 has the current temperature $T_0$ (degrees Celsius) is 20 degrees Celsius at a time at which the image data to be printed on the recording medium 21 is transmitted from the host device 61 to the control unit 51, and the data process for the print operation is completed. That is, the fixing roller 35 has the current temperature $T_0$ (degrees Celsius) is 20 degrees Celsius at a time at which the print operation is startable. A horizontal axis of FIG. 3 represents the successive print sheet number (x), and a vertical axis of FIG. 3 represents the power consumption amount Wn (Wh) in the fixing device 34. The recording medium 21, for example, is an A4 sized sheet having a length L (mm) of 297 mm and is conveyed in a vertical direction. Each of the recording media 21 has, for example, a distance "d" of 50 mm therebetween in the successive print operation. Herein, since the print time is proportional to the print speed Vn (mm/sec), the slower the print speed Vn (mm/sec), the greater the power consumption amount Wn (Wh) in the fixing device 34 with an increase in the successive print sheet number. On the other hand, in a case where the successive print sheet number is small, the slower the print speed Vn (mm/sec), the smaller the power consumption amount Wn (Wh) in the fixing device 34. In a case where the successive print sheet number is small, the set target temperature Tn (degrees Celsius) of the fixing roller 35 can be set low, thereby suppressing and the power consumption amount Pw (W) needed to increase the temperature of the fixing roller 35 from the current temperature $T_0$ (degrees Celsius) to the set target temperature Tn (degrees Celsius).

Figure 4:
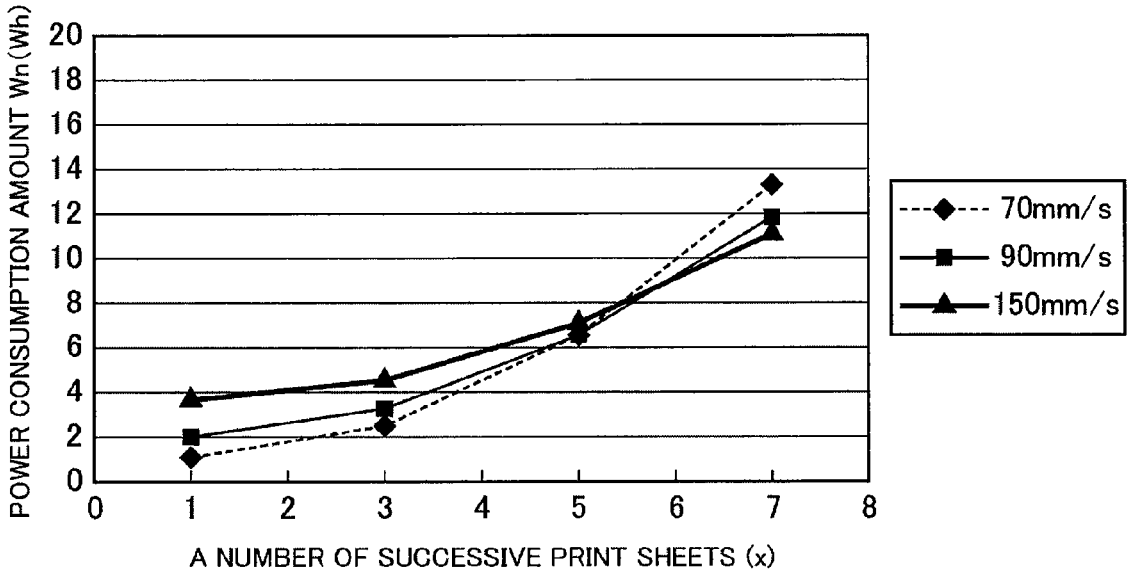
FIG. 4 is a graph illustrating a relationship between a number of successive print sheets and a power consumption amount with respect to each print speed in a case where the image forming apparatus according to the first embodiment of the present invention is started from a temperature of 100 degrees Celsius.

Referring to FIG. 4, a relationship between the power consumption amount Wn (Wh) in the fixing device 34 and the number of successive print sheets (x) with respect to each print speed Vn (mm/sec) in a case where the current temperature $T_0$ (degrees Celsius) is adequately high is illustrated. Herein, the current temperature $T_0$ (degrees Celsius) of the fixing roller is 100 (degrees Celsius) where the print operation is startable.

According to a comparison of FIG. 3 and FIG. 4, the power consumption amount Wn (Wh) of FIG. 4 is smaller than that of FIG. 3. Since the fixing roller 35 of FIG. 4 can reduce the power consumption amount Pw (W) needed to increase the temperature thereof from the current temperature $T_0$ (degrees Celsius) to the set target temperature Tn (degrees Celsius), the power consumption amount Wn (Wh) for the fixing roller 35 having the temperature $T_0$ (degrees Celsius) of 100 (degrees Celsius) is smaller than that for the fixing roller 35 having the temperature $T_0$ (degrees Celsius) of 20 (degrees Celsius). Other characteristics relating to the power consumption amount are substantially similar to those described above with reference to FIG. 3, and descriptions thereof are omitted.

A description is now given of the set target temperature Tn (degrees Celsius) of the fixing roller 35 and the print speed Vn (mm/sec) with reference to TABLE 2. The set target temperature Tn (degrees Celsius) of the fixing roller 35 and the print speed Vn (mm/sec) need to be set for development of the image data on the recording medium 21 with good image quality.

TABLE 2

| | CLASS OF RECORDING MEDIUM | | | | | | | | |
|---|---|---|---|---|---|---|---|---|---|
| | THIN (M1) | | | REGULAR THICKNESS (M2) | | | THICK (M3) | | |
| | M11 | M12 | M13 | M21 | M22 | M23 | M31 | M32 | M33 |
| SET TARGET TEMP. OF FIXING ROLLER Tn (° C.) | T11 | T12 | T13 | T21 | T22 | T23 | T31 | T32 | T33 |
| PRINT SPEED Vn (mm/sec) | V11 | V12 | V13 | V21 | V22 | V23 | V31 | V32 | V33 |

As shown in TABLE 2, three classes (a thin sheet M1, a regular thickness sheet M2, and a thick sheet M3) of the recording media 21 are used for the print operation. Each of the three classes corresponds to three print modes (Mn1, Mn2, and Mn3) to develop the image data on the recording medium 21. Particularly, for example, the thin sheet M1 corresponds to the three modes M11, M12, and M13 according to the first embodiment of the present invention. However, one class of the recording medium 21 may preferably correspond to at least two print modes, and a variety of the print speed Vn (mm/sec) may not necessarily be set.

Referring to TABLE 3, an example of an operation condition of the image forming apparatus 1 developing the image data on the recording medium 21 and an example of the print data to be transmitted from the host device 61 to the control unit 51 are tabled. Herein, the recording medium 21 having the regular thickness of M2 is selected as an example. The condition in TABLE 3 is used to determine the print mode such that the power consumption Wn (Wh) in the fixing roller 35 becomes the smallest, and such determination of the print mode is described with reference to FIG. 5

TABLE 3

| PARAMETER | UNIT | DESCRIPTION OF PARAMETER |
|---|---|---|
| $T_0$ | (° C.) | CURRENT TEMP. OF FIXING ROLLER $T_0 = 100$ |
| Tn | (° C.) | SET TARGET TEMP. OF FIXING ROLLER T21 = 130, T22 = 150, T23 = 180 |
| x | (SHEET) | SUCCESSIVE PRINT SHEET NUMBER OF RECORDING MEDIUM x = 2 |
| L | (mm) | LENGTH OF RECORDING MEDIUM L = 297 |
| d | (mm) | DISTANCE BETWEEN RECORDING MEDIA IN THE COURSE OF SUCCESSIVE PRINT OPERATION d = 50 |
| Vn | (mm/sec) | PRINT SPEED OF RECORDING MEDIUM V21 = 70, V22 = 90, V23 = 150 |
| Pw | (W) | POWER CONSUMPTION NEEDED TO INCREASE TEMP. OF FIXING ROLLER TO SET TARGET TEMP. FROM TEMP. AT BEGINNING OF OPERATION OF IMAGE FORMING APPARATUS Pw = 1000 |
| Pc | (W) | POWER CONSUMPTION NEEDED TO PERFORM PRINT OPERATION BY OPERATION OF IMAGE FORMING APPARATUS ON CONDITION OF CERTAIN TEMP. T AND CERTAIN SPEED V Pc = 400 |
| a | (° C./sec) | TEMP. GRADIENT FOR SURFACE TEMP. OF FIXING ROLLER TO BE INCREASED IN ONE SECOND a = 8 |

Figure 5:
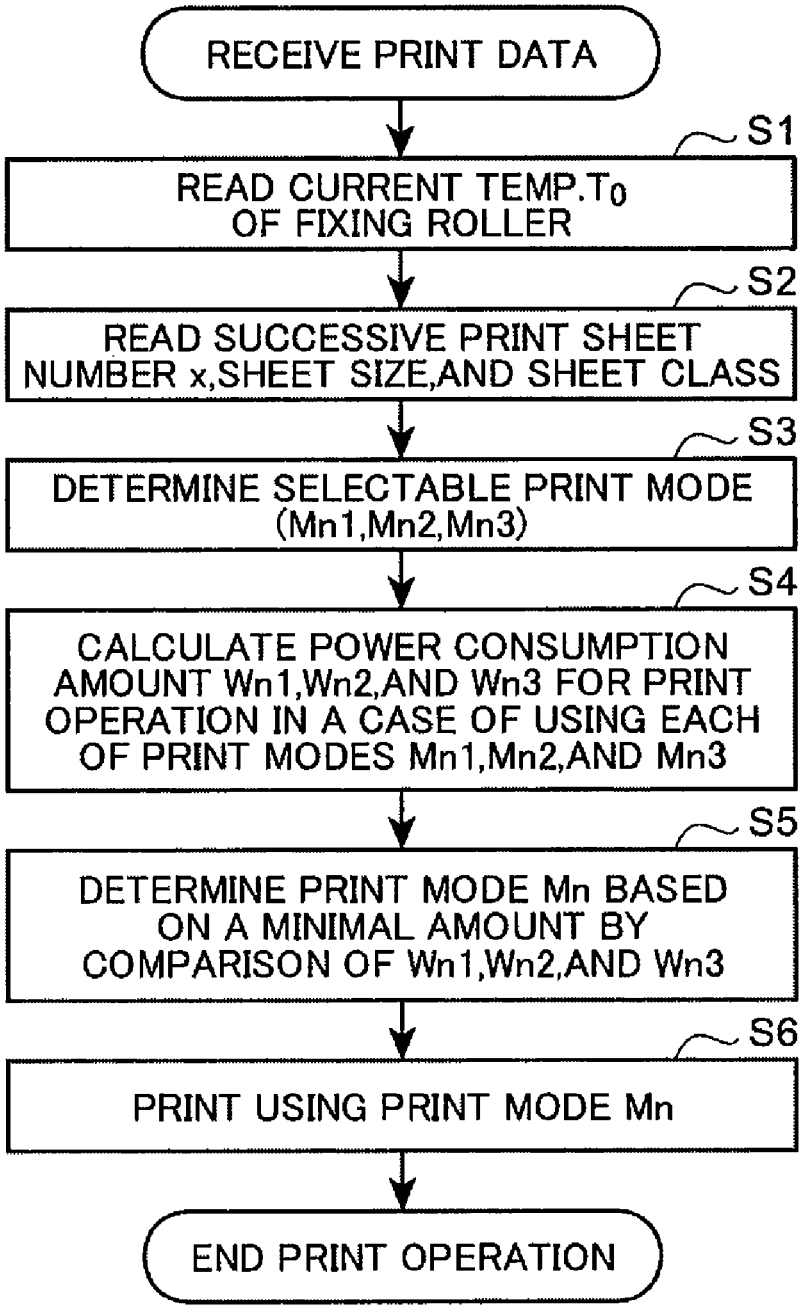
FIG. 5 is a flowchart illustrating an example procedure for determining a print mode such that the power consumption amount of the image forming apparatus according to the first embodiment of the present invention becomes the smallest and for performing print operation.

Referring to a flowchart of FIG. 5, an example procedure in a case where the print mode is determined such that the power consumption amount Wn (Wh) in the fixing roller 35 becomes the smallest is described.

When the control unit 51 receives the print data transmitted from the host device 61, the current temperature $T_0$ (degrees Celsius) of the fixing roller 35 is measured by the thermistor 37 and is read into the control unit 51, and sequence of print mode determination and the print operation is started (step S1). Subsequently, information relating to the successive print sheet number (x), a size of the recording medium 21, and the class of the recording medium 21 is read into the control unit 51 from the print data transmitted from the host device 61. Herein, the length L (mm) of the sheet is obtained from the size of the recording medium 21 (step S2). Subsequently, selectable print modes are determined to be M21, M22, and M23 with reference to TABLE 2. Herein, the regular thickness M2 is selected for the recording medium 21 (step S3).

Subsequently, power consumption amounts W21, W22, and W23 needed for development of the image data on the recording medium 21 by the respective print modes are calculated. The power consumption amount W21 (Wh) is derived from Formulas 4 through 6 (stated later), the power consumption amount W22 (Wh) is derived from Formulas 7 through 9 (stated later), and the power consumption amount W23 (Wh) is derived from Formulas 10 through 12 (stated later). Where the condition stated in TABLE 3 exists, the power consumption amounts W21, W22, and W23 are respectively calculated as 2.06 Wh, 2.53 Wh, and 3.25 Wh based on the Formulas 4 through 12 (step S4).

$$tw=(Tn-T_0)/a=(130-100)/8=3.75 \text{ sec.} \quad \text{Formula 4}$$

$$tc=\{x\times L+(x-1)\times d\}/Vn=\{2\times 297+(2-1)\times 50\}/70=9.20 \text{ sec.} \quad \text{Formula 5}$$

$$W21=(Pw\times tw+Pc\times tc)/60/60=(1000\times 3.75+400\times 9.20)/60/60=2.06 \text{ Wh} \quad \text{Formula 6}$$

$$tw=(Tn-T_0)/a=(150-100)/8=6.25 \text{ sec} \quad \text{Formula 7}$$

$$tc=\{x\times L+(x-1)\times d\}/Vn=\{2\times 297+(2-1)\times 50\}/90=7.16 \text{ sec} \quad \text{Formula 8}$$

$$W22=(Pw\times tw+Pc\times tc)/60/60=(1000\times 6.25+400\times 7.16)/60/60=2.53 \text{ Wh} \quad \text{Formula 9}$$

$$tw=(Tn-T_0)/a=(180-100)/8=10.0 \text{ sec} \quad \text{Formula 10}$$

$$tc=\{x\times L+(x-1)\times d\}/Vn=\{2\times 297+(2-1)\times 50\}/150=4.29 \text{ sec} \quad \text{Formula 11}$$

$$W23=(Pw\times tw+Pc\times tc)/60/60=(1000\times 10.0+400\times 4.29)/60/60=3.25 \text{ Wh} \quad \text{Formula 12}$$

The power consumption amounts W21 of 2.06 Wh, W22 of 2.53 Wh, and W23 of 3.25 Wh are compared, and the print mode is determined to be M21 based on the power consumption amount W21 of 2.06 Wh having the smallest amount among the W21, W22, and W23 (step S5). Subsequently, the set target temperature Tn (degrees Celsius) and the print speed Vn (mm/sec) are read from TABLE 2 showing the set target temperature Tn (degrees Celsius) of the fixing roller 35 for each recording medium 21 and the print speed Vn (mm/sec). The sequence relating to the determination of the print mode and the print operation is ended after the print data is developed on the recording medium 21 (step S6).

According to the first embodiment described above, the image forming apparatus 1 can calculate the print mode "Mn" consuming the smallest amount of the power consumption Wn (Wh) based on the information such as the successive print sheet number (x) relating to the print data transmitted from the host device 61 and the current temperature $T_0$ (degrees Celsius) of the fixing roller 35, and can perform the print operation. For example, in a case where the print operation is performed using the print mode M21 under the condition stated in TABLE 3, the power consumption amount Wn (Wh) can be reduced by 37% compared with a case where the print operation is performed using the print mode M23. As described above, the appropriate print mode is calculated to perform the print operation, thereby suppressing the power consumption amount Wn (Wh).

Second Embodiment

An image forming apparatus 100 according to a second embodiment of the present invention includes a control mechanism capable of selecting a plurality of print modes and a fixing device fixing a developed image based on the print mode selected by the control mechanism. The control mechanism determines the print mode based a number of successive print sheets (also referred to as a successive print sheet number) determined based on print information received from a host device, a power consumption amount of each of the print modes determined based on fixing temperature of the fixing device prior to starting print operation, a total print time for the print operation, and a priority sequence parameter set beforehand indicating priority to the power consumption amount or print speed, so that the image forming apparatus 100 performs the print operation using such a print mode.

The image forming apparatus 100 according to the second embodiment of the present invention is now described in detail. Since the image forming apparatus 100 according to the first embodiment is substantially similar to that of the image forming apparatus 1 according to the first embodiment described above except for a user interface used to select the priority sequence of the power consumption amount Wn (Wh) and the print speed Vn (mm/sec), the user interface will be described while like components will be given the same reference numerals as above and description thereof will be omitted.

Figure 6:
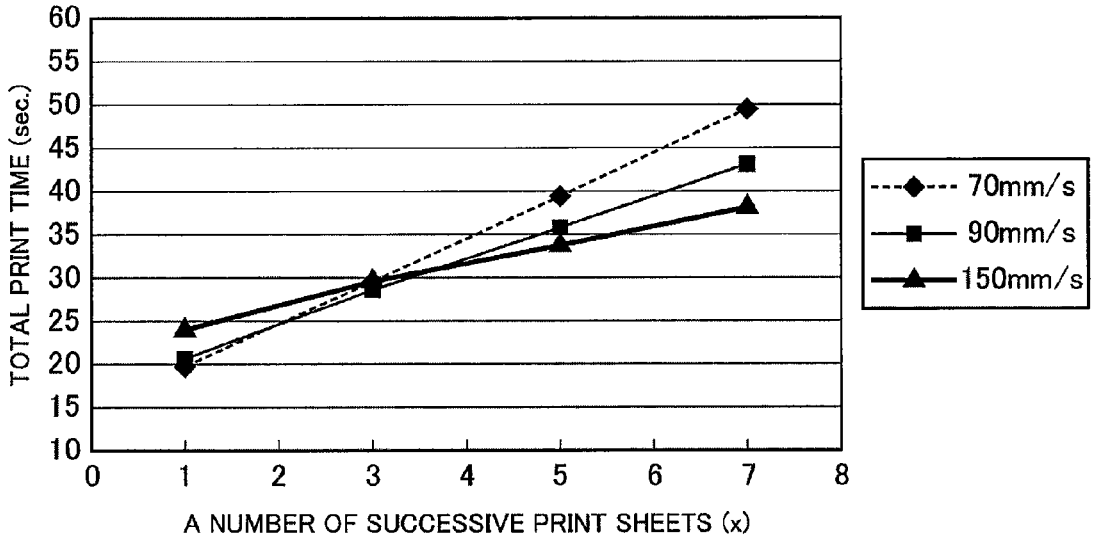
FIG. 6 is a graph illustrating a relationship between a number of successive print sheets and total print time with respect to each print speed in a case where an image forming apparatus according to a second embodiment of the present invention is started from a temperature of 20 degrees Celsius.

Referring to FIG. 6, a relationship between the number of the successive print sheets (x) and total print time (sec) with respect to each print speed Vn (mm/sec) is illustrated. The fixing roller 35 has a current temperature $T_0$ (degrees Celsius) of 20 degrees Celsius where the print operation is startable. The print speed Vn is 70, 90, and 150 (mm/sec) as illustrated in FIG. 6.

Herein, the fixing roller 35 has the current temperature $T_0$ (degrees Celsius) of 20 degrees Celsius at a time at which image data to be printed on a recording medium 21 is transmitted from the host device 61 to the control unit 51, and the data process for the print operation is completed. That is, the fixing roller 35 has the current temperature $T_0$ (degrees Celsius) of 20 (degrees Celsius) at a time at which the print operation is startable. A horizontal axis of FIG. 6 represents the number of successive print sheets (x), and a vertical axis of FIG. 6 represents the total print time. The recording medium 21, for example, is an A4 sized sheet having a length L (mm) of 297 mm and is conveyed in a vertical direction. Each of the recording media 21 has, for example, a distance "d" of 50 mm therebetween in the successive print operation. Herein, the total print time is proportional to the successive print sheet number (x). However, in case where the successive print sheet number (x) is small, the total print time is short although the print speed Vn (mm/sec) is set to be slow. In a case where the print speed Vn (mm/sec) is set to be slow, a set target temperature Tn (degrees Celsius) of the fixing roller 35 can be set to be low, thereby shortening the time needed to increase the temperature of the fixing roller 35 from the current temperature $T_0$ (degrees Celsius) of 20 degrees Celsius to the set target temperature Tn (degrees Celsius) for the print operation to be performable. However, in a case where the successive print sheet number (x) increases, an amount of a time needed to increase the temperature of the fixing roller 35 to the set target temperature Tn (degrees Celsius) decreases in proportion to the total print time. That is, since the total print time heavily depends on the print speed Vn (mm/sec) in a case of an increase in the successive print sheet number (x), the total print time can be shortened by the print mode having high print speed Vn (mm/sec).

Herein, a comparison is made between the relationship between the power consumption amount (Wh) and the successive print sheet number (x) described with reference to FIG. 3 according to the above first embodiment and the relationship between the total print time (sec) and the successive print sheet number (x) of FIG. 6. For example, where the comparison is made between the print mode having the print speed Vn (mm/sec) of 70 mm/sec and the print mode having the print speed of 150 mm/sec, the power consumption amount (Wh) and the total print time consumed by the print mode having the print speed Vn (mm/sec) of 70 mm/sec are respectively smaller and shorter than those consumed by the print mode having the print speed of 150 mm/sec in a case of the successive print sheet number (x) of less than three (3). However, where the successive print sheet number (x) exceeds six (6), the power consumption amount (Wh) and the total print time consumed by the print mode having the print speed Vn (mm/sec) of 150 mm/sec are respectively smaller and shorter than those consumed by the print mode having the print speed of 70 mm/sec.

Figure 7:
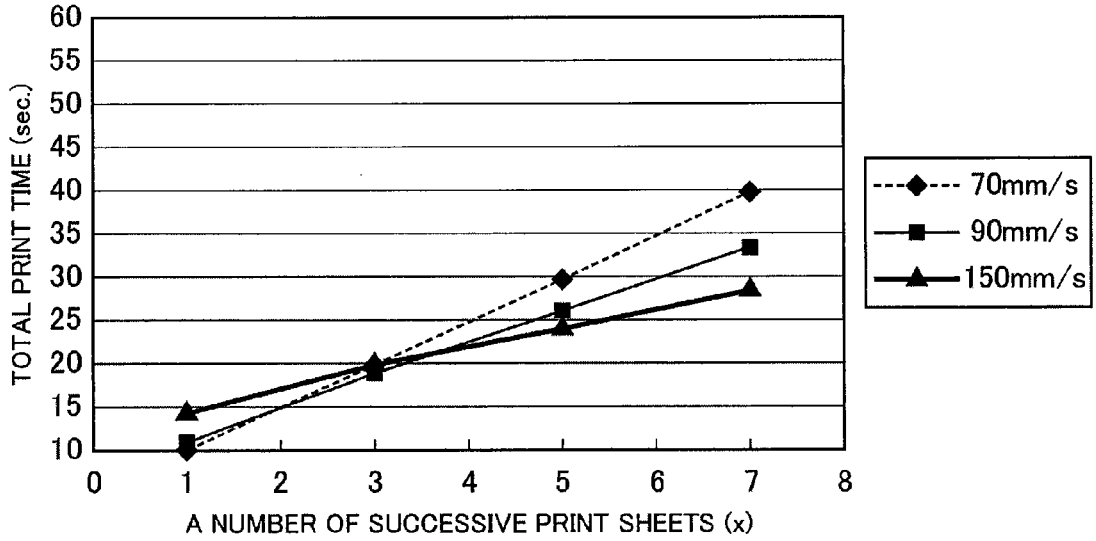
FIG. 7 is a graph illustrating a relationship between a number of successive print sheets and total print time with respect to each print speed in a case where the image forming apparatus according to the second embodiment of the present invention is started from a temperature of 100 degrees Celsius.

Referring to FIG. 7, a description is given of a relationship between the successive print sheet number (x) and the total print time with respect to each print time Vn (mm/sec). The print speed Vn is 70, 90, and 150 (mm/sec) as illustrated in FIG. 7. A current temperature $T_0$ (degrees Celsius) of the fixing roller 35 is 100 (degrees Celsius) at a time at which the print operation is startable.

Herein, a comparison is made between FIG. 6 and FIG. 7. The total print time is shorter where the fixing roller 35 has the temperature of 100 (degrees Celsius) at a time a which the print operation is startable (i.e, FIG. 7) compared with the fixing roller 35 having the temperature of 20 (degrees Celsius) a time at which the print operation is startable (i.e., FIG. 6). The fixing roller 35 having the temperature of 100 (degrees Celsius) can allow the time needed to increase the temperature thereof from the current temperature $T_0$ (degrees Celsius) to the target set temperature Tn (degrees Celsius) to be shorten for the print operation to be performable, thereby shortening the total print time. Other characteristics relating to the power consumption amount are substantially similar to those described above with reference to FIG. 6, and descriptions thereof are omitted.

Figure 8:
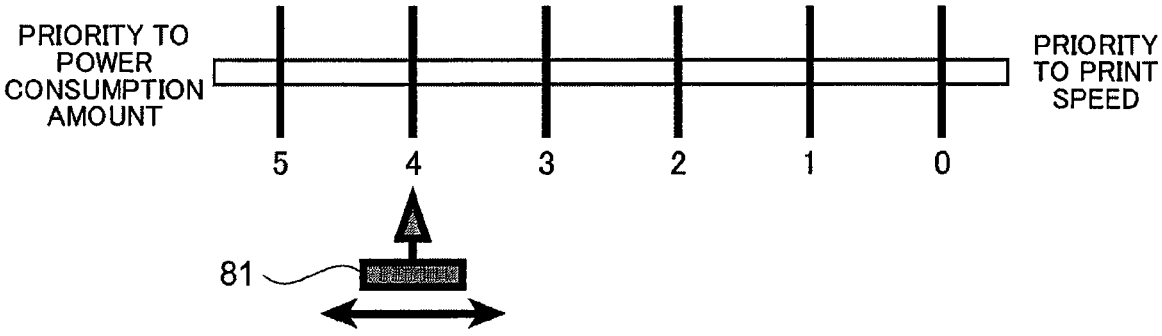
FIG. 8 is a schematic diagram illustrating an example of user interface used to select priority sequence of the power consumption amount and the print speed in the image forming apparatus according to the second embodiment of the present invention.

Referring to FIG. 8, an example of the user interface used to select priority sequence of the power consumption amount Wn (Wh) and the print speed Vn (mm/sec) by an operator of the image forming apparatus 100 is illustrated.

The operator of the image forming apparatus 100 operates a priority sequence setting unit 81 to select the priority sequence of the power consumption amount Wn (Wh) (Wh) and the print speed Vn (mm/sec) from zero (0) to five (5) as the priority sequence parameter "k" as illustrated in FIG. 8. For example, the priority sequence parameter "k" is set inside the control unit 51 in which the print data transmitted from the host device 61 is received, or the priority sequence parameter "k" is set through the input unit 64 described above with reference to FIG. 2. In a case where the priority sequence parameter "k" is set to be five (5), a decrease in the power source amount Wn (Wh) is prioritized. In a case where the priority sequence parameter "k" is set to be one (1), acceleration of the print speed Vn (mm/sec) is prioritized.

Referring to TABLE 4, the power consumption amount Wn (Wh), the total print time "tn" (sec), and a judgment score "Hn" with respect to each print speed Vn (mm/sec) are tabled.

TABLE 4

| | PRINT SPEED Vn (mm/sec) | | |
|---|---|---|---|
| | 70 | 90 | 150 |
| POWER CONSUMPTION AMOUNT Wn(Wh) | 2.61 | 2.96 | 3.51 |
| TOTAL PRINT TIME (sec) | 17.9 | 17.3 | 16.6 |
| JUDGMENT SCORE Hn (k = 0) | 89.5 | 86.3 | 83.0 |
| JUDGMENT SCORE Hn (k = 3) | 43.7 | 43.4 | 43.7 |
| JUDGMENT SCORE Hn (k = 5) | 13.1 | 14.8 | 17.6 |

The recording medium 21, for example, is an A4 sized sheet having a length L (mm) of 297 mm and is conveyed in a vertical direction. Each of the recording media 21 has, for example, a distance "d" of 50 mm therebetween in the successive print operation. The successive print sheet number (x) is three (3). The fixing roller 35 has the current temperature $T_0$ (degrees Celsius) of 100 (degrees Celsius). Herein, the judgment score "Hn" indicates a print efficiency for the power consumption Wn (Wh) and the total print time "tn" (sec). The smaller the value of the judgment score "Hn," the greater the print efficiency. Where the priority sequence parameter "k" is zero (0), three (3), and five (5), the judgment score "Hn" is set to be H21, H22, and H23, respectively. The judgment score "Hn" is calculated by Formula 13 (stated later). Particularly, for example, in a case where the operator designates the priority parameter "k" to be zero (0), a value of the judgment score H21 with respect to the print speed 150 mm/sec is the smallest among values of the judgment score H21 with respect the print speed 70, 90, and 150 mm/sec, thereby providing the good print efficiency. Similarly, in a case where the operator designates the priority parameter "k" to be three (3), a value of the judgment score H22 with respect to the print speed of 90 mm/sec is the smallest, thereby providing the good print efficiency. In a case where the operator designates the priority sequence parameter "k" to be the largest value thereof, that is, five (5), a value of the judgment score H23 with respect to the print speed of 70 mm/sec is the smallest, thereby providing the good print efficiency.

$$Hn = k \times Wn + (k\max - k) \times tn \qquad \text{Formula 13}$$

In a case where a ratio of the power consumption amount Wn (Wh) and the total print time "tn" (sec) widely differs from the above example, ratio adjustment parameters "m" and "n" may be set. Herein, the judgment score "Hn" is calculated by Formula 14.

$$Hn = k \times (Wn \times m) + (k\max - k) \times (tn \times n) \qquad \text{Formula 14}$$

Figure 9:
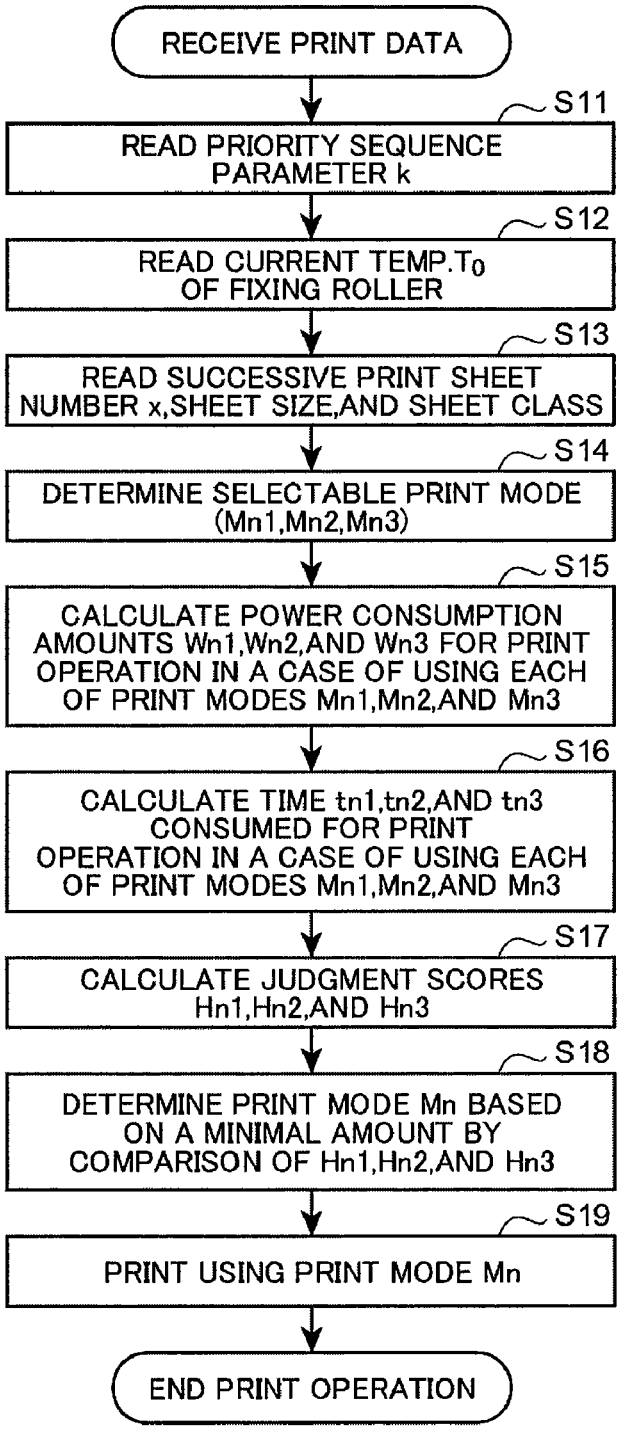
FIG. 9 is a flowchart illustrating an example procedure for determining a print mode such that the power consumption amount and the total print time of the image forming apparatus according to the second embodiment of the present invention becomes the smallest and for performing print operation.

Referring to a flowchart of FIG. 9, an example procedure in a case where the print mode is determined such that the print efficiency for the power consumption amount Wn (Wh) in the fixing roller 35 and the total print time becomes appropriate is described with the print operation.

When the control unit 51 receives the print data transmitted from the host device 61, the priority sequence parameter "k" determined inside the control unit 51 or by the operator through the input unit 64 is read, and sequence relating to the print mode determination and the print operation is started (step S11). Since subsequence steps 12 through 15 are substantially similar to those steps 1 through 4 with respect to the flowchart of FIG. 5, descriptions thereof are omitted. The total print time "tn" (sec) needed to perform the print operation in a case of using the print modes Mn1, Mn2, and Mn3 is calculated (step S16). Subsequently, the judgment scores Hn1, Hn2, and Hn3 are calculated using the Formula 13 (step S17). Subsequently, the judgment scores Hn1, Hn2, and Hn3 are compared. The smallest amount is determined to be the judgment score "Hn" based on the comparison, and the print mode "Mn" is determined (step S18). After the print data is developed on the recording medium 21 using the print mode "Mn," the sequence relating to the print mode determination and the print operation is ended (step S19).

According to the second embodiment of the present invention described above, the image forming apparatus 100 is capable of selecting the appropriate print mode based on the priority sequence of the power consumption amount Wn (Wh) and the print speed Vn (mm/sec) by determination of the priority sequence parameter "k" by the operator. For example, in a case where the total print time has no constraint, the print mode appropriate for suppression of the power consumption amount Wn (Wh) can be selected. Moreover, in a case where the total print time needs to be shortened, for example in an office, the print mode appropriate for the acceleration of the print speed Vn (mm/sec) can be selected.

According to the above first and second embodiments, the image forming apparatuses 1 and 100 serving as the printers are described. However, each of the embodiments may be applied to an image forming apparatus such as a facsimile machine, a photocopier, and a multi-functional peripheral.

The present invention has been described above with regard to particular embodiments, but the present invention is not limited thereto. As can be appreciated by those skilled in the art, numerous additional modifications and variation of the present invention are possible in light of the above-described teachings. It is therefore to be understood that, within the scope of the appended claims, the disclosure of this patent specification may be practiced otherwise than as specifically described herein.

What is claimed is:

1. An image forming apparatus comprising:

a control mechanism capable of selecting a plurality of print modes; and a fixing device fixing an image, developed based on one of the print modes selected by the control mechanism, on a recording medium, wherein the control mechanism selects one of the print modes consuming a smallest amount of power, based on a number of successive print sheets determined by print information received from a host device and a power consumption amount of each of the print modes calculated from a fixing temperature of the fixing device prior to starting a print operation.

2. The image forming apparatus according to claim 1, wherein the plurality of print modes correspond to a plurality of respective print speed sets, each of the print speed sets having a different speed, and wherein the control mechanism includes:

a power consumption amount computation unit computing the power consumption amount with respect to each of the plural print speed sets based on the successive print sheet number and recording medium information for the recording medium; and a print speed setting unit setting the print speed such that the power consumption amount becomes the smallest based on a result computed by the power consumption amount computation unit.

3. The image forming apparatus according to claim 2, wherein the recording medium information includes information relating to a size and a thickness of the recording medium.

4. The image forming apparatus according claim 1, wherein the number of successive print sheets is a number of sheets of a print job received from a host device.

5. The image forming apparatus according to claim 1, wherein the power consumption amount is calculated based on a power consumption of the fixing device, print speed, and a number of successive print sheets.

6. The image forming apparatus according to claim 5, wherein the power consumption of the fixing device is calculated based on a current temperature of the fixing device and a set target temperature of the fixing device.

7. An image forming apparatus comprising:

a control mechanism capable of selecting a plurality of print modes; and a fixing device fixing, an image developed based on one of the print modes selected by the control mechanism, on a recording medium, wherein, the control mechanism determines one of the print modes based on a number of successive print sheets determined by print information received from a host device, a power consumption amount of each of the print modes determined from fixing temperature of the fixing device prior to starting print operation, a total print time for print operation, and a priority sequence parameter set beforehand indicating a power consumption amount priority or a print speed priority, and allows the print operation to be performed using the print mode determined.

8. The image forming apparatus according to claim 7, wherein the plurality of print modes correspond to a plurality of respective print speed sets, and wherein the control mechanism includes:

a power consumption amount computation unit computing the power consumption amount with respect to each of the plural print speed sets based on the successive print sheet number and recording medium information for the recording medium;

a total print time computation unit computing total print time with respect to each of the plural print speed sets based on the successive print sheet number and recording medium information for the recording medium; and a print speed setting unit setting print speed based on a judgment value determined by addition of a value obtained by multiplying the priority sequence parameter by the power consumption amount to a value obtained by multiplying the total print time by a value obtained by subtracting a current priority sequence parameter from a largest obtainable value of the priority sequence parameter.

9. The image forming apparatus according to claim 7, wherein the priority sequence parameter is transmitted from the host device.

10. The image forming apparatus according to claim 7, wherein the priority sequence parameter is set inside the image forming apparatus.

11. The image forming apparatus according to claim 7, wherein the power consumption amount is calculated based on a power consumption of the fixing device, print speed, and a number of successive print sheets.

12. The image forming apparatus according to claim 11, wherein the power consumption of the fixing device is calculated based on a current temperature of the fixing device and a set target temperature of the fixing device.

13. An image forming apparatus comprising:

a control mechanism capable of selecting a plurality of print modes, wherein the plurality of print modes correspond to a plurality of respective print speed sets, the control mechanism including:

i) a power consumption amount computation unit computing the power consumption amount with respect to each of the plural print speed sets based on the successive print sheet number and recording medium information for the recording medium;

ii) a total print time computation unit computing total print time with respect to each of the plural print speed sets based on the successive print sheet number and recording medium information for the recording medium; and iii) a print speed setting unit setting print speed based on a judgment value determined by addition of a value obtained by multiplying the priority sequence parameter by the power consumption amount to a value obtained by multiplying the total print time by a value obtained by subtracting a current priority sequence parameter from a largest obtainable value of the priority sequence parameter;

a fixing device fixing, an image developed based on one of the print modes selected by the control mechanism, on a recording medium, wherein, the control mechanism determines one of the print modes based on a number of successive print sheets determined by print information received from a host device, a power consumption amount of each of the print modes determined from fixing temperature of the fixing device prior to starting print operation, a total print time for print operation, and a priority sequence parameter set beforehand indicating a power consumption amount priority or a print speed priority, and allows the print operation to be performed using the print mode determined, wherein the print speed setting unit includes a ratio adjustment parameter "m" stored beforehand and a ratio adjustment parameter "n," and determines the judgment value by a formula, $Hn=k\times(Wn\times m)+(kmax-k)\times(tn\times n)$, wherein the "Hn" represents the judgment value, the "k" represents the priority sequence parameter, the "Wn" represents the power consumption amount, the "m" represents the ratio adjustment parameter stored beforehand, the "kmax" represents the largest value obtainable by the priority sequence parameter, the "tn" represents the total print time, and the "n" represents the ratio adjustment parameter.

14. The image forming apparatus according claim 13, wherein the recording medium information includes information relating to a size and a thickness of the recording medium.

* * * * *